US009302153B2

(12) United States Patent
Harwin

(10) Patent No.: US 9,302,153 B2
(45) Date of Patent: Apr. 5, 2016

(54) THERAPEUTIC DEVICE FOR IMPROVING NEUROMUSCULAR BALANCE AND PAIN CONDITIONS

(71) Applicant: Ronald Harwin, Richmond, CA (US)

(72) Inventor: Ronald Harwin, Richmond, CA (US)

( * ) Notice: Subject to any disclaimer, the term of this patent is extended or adjusted under 35 U.S.C. 154(b) by 517 days.

(21) Appl. No.: 13/771,027

(22) Filed: Feb. 19, 2013

(65) Prior Publication Data

US 2013/0316885 A1 Nov. 28, 2013

Related U.S. Application Data

(63) Continuation-in-part of application No. 11/944,654, filed on Nov. 26, 2007, now abandoned.

(51) Int. Cl.

| | |
|---|---|
| ***A63B 26/00*** | (2006.01) |
| ***A63B 21/02*** | (2006.01) |
| ***A63B 21/04*** | (2006.01) |
| ***A63B 21/068*** | (2006.01) |
| ***A63B 22/16*** | (2006.01) |
| ***A61H 1/00*** | (2006.01) |
| ***A63B 23/035*** | (2006.01) |
| ***A63B 23/10*** | (2006.01) |

(Continued)

(52) U.S. Cl.

CPC ..... *A63B 26/003* (2013.01); *A61H 1/005* (2013.01); *A63B 21/023* (2013.01); *A63B 21/0421* (2013.01); *A63B 21/068* (2013.01); *A63B 21/4015* (2015.10); *A63B 21/4047* (2015.10); *A63B 22/16* (2013.01); *A63B 23/03508* (2013.01); *A63B 23/03541* (2013.01); *A63B 23/10* (2013.01); *A61H 2201/1284* (2013.01); *A61H 2201/164* (2013.01); *A61H 2203/0406* (2013.01); *A63B 21/05* (2013.01); *A63B 21/055* (2013.01); *A63B 2022/0092* (2013.01); *A63B 2026/006* (2013.01); *A63B 2220/52* (2013.01)

(58) Field of Classification Search

CPC ..... A63B 26/003; A63B 21/0421; A63B 21/068; A63B 21/143; A63B 21/1492; A63B 21/023; A63B 21/05; A63B 21/055; A63B 22/16; A63B 23/10; A63B 23/03508; A63B 23/03541; A63B 2022/0092; A63B 2026/006; A63B 2220/52; A61H 1/005; A61H 2203/0406; A61H 2201/164; A61H 2201/128

USPC ..... 601/23, 24, 27–35; 482/8, 51, 52, 70, 482/79, 80, 128, 142

See application file for complete search history.

(56) References Cited

U.S. PATENT DOCUMENTS

| | | | | |
|---|---|---|---|---|
| 1,587,749 | A | 7/1924 | Bierly | |
| 3,638,940 | A * | 2/1972 | Mehaulic | 482/51 |

(Continued)

FOREIGN PATENT DOCUMENTS

| | | | |
|---|---|---|---|
| KR | 20-0327780 | Y1 | 9/2003 |
| KR | 20-0369647 | Y1 | 12/2004 |

(Continued)

*Primary Examiner* — Quang D Thanh

(74) *Attorney, Agent, or Firm* — Vierra Magen Marcus LLP

(57) ABSTRACT

A therapeutic device includes a base and a platform supported by springs. The platform may be attached to the base by hinges. An upper platform may be rotatably attached to the platform such that it rotates about an axis located above the platforms. The upper platform may be biased by springs between the upper platform and the platform. Handlebars may also be Incorporated into the device. A variety of interchangeable. Springs may be provided to assist in adjusting the therapeutic device.

15 Claims, 6 Drawing Sheets

(51) Int. Cl.

| | |
|---|---|
| *A63B 21/05* | (2006.01) |
| *A63B 22/00* | (2006.01) |
| *A63B 21/055* | (2006.01) |

(56) References Cited

U.S. PATENT DOCUMENTS

| | | | | |
|---|---|---|---|---|
| 4,279,415 | A * | 7/1981 | Katz | 482/80 |
| 5,845,419 | A * | 12/1998 | Begg | 36/7.8 |
| 6,468,237 | B1 | 10/2002 | Lina | |
| 6,585,669 | B2 * | 7/2003 | Manor et al. | 601/152 |
| 6,654,705 | B1 | 11/2003 | Benson et al. | |
| 6,705,975 | B2 * | 3/2004 | Kuo | 482/80 |
| 6,976,939 | B2 * | 12/2005 | Harker et al. | 482/52 |

FOREIGN PATENT DOCUMENTS

| | | | |
|---|---|---|---|
| KR | 10-0499089 | B1 | 7/2005 |
| KR | 10-2006-0114824 | A | 11/2006 |
| WO | 2006118377 | A1 | 11/2006 |
| WO | 2009070325 | A1 | 6/2009 |

* cited by examiner

THERAPEUTIC DEVICE FOR IMPROVING NEUROMUSCULAR BALANCE AND PAIN CONDITIONS

CROSS-REFERENCE TO RELATED APPLICATIONS

This Utility patent application is a Continuation-in-Part of pending Utility patent application Ser. No. 11/944,654 filed on Nov. 26, 2007.

STATEMENT REGARDING FEDERALLY SPONSORED

Not Applicable

RESEARCH OR DEVELOPMENT

Not Applicable

REFERENCE TO SEQUENCE LISTING, A TABLE, OR A COMPUTER

Not Applicable

PROGRAM LISTING COMPACT DISC APPENDIX

Not Applicable

FIELD

The present invention relates to systems and devices for improving a person's balance and otherwise improving neuromuscular coordination. More particularly, the invention relates to using a therapeutic device to access the plasticity inherent in the human central nervous system to reorganize it to a healthier, more effective level of function.

BACKGROUND

Many people have suffered with chronic injuries and/or diseases that have affected their body for a long time. Their body tends to adapt and compensate. Many people may suffer from pain syndromes resulting from such compensations to injuries. The injuries and/or diseases can weaken the mechanical process of the body and/or disrupt the pattern of bodily movement, either of which often can lead to deformations of bone, joints and/or tissues connecting the bones and/or joints. No one today could reasonably say that these problems can be solved with a machine, and neither can the inventor, but after years of research he is disclosing in this application tools he has found to fundamentally aid the body's own processes to improve health.

As the population ages, more and more people have recently suffered from fall fracture, loss of muscle strength, decreased range of joint motion, reduced sense of balance or the like due to aging. Accordingly, more and more patients need rehabilitation of walking function.

Poor balance and ineffective gait can be severely debilitating problems. They can drastically limit a person's mobility and make relatively simple activities difficult or impossible. Furthermore, it can be very dangerous. A person with poor balance or gait is more likely to slip, fall or fall downstairs. It can also be disorienting and confusing.

Unfortunately, there has been relatively little attention focused on this growing problem. Persons with balance or gait problems typically must rely on using a cane, crutches or a walker. Real solutions have been slow in coming.

SUMMARY

The present invention may include a simple but sophisticated mechanical device that persons may stand on to manage pain and improve balance conditions. Measurable, oftentimes life-transforming changes may be elicited with predictable efficiency on deep and subtle levels within the patient's Central Nervous System (CNS).

Accordingly, an object of the present invention is to provide a therapeutic device that may improved balance, increase gait efficiency and stability, enhance coordination and performance, facilitate the healing of injuries and trauma patterns, decompress spinal discs, improved circulation, improve postural alignment, stimulate static, righting and static-kinetic reflexes and reduce stress.

It is also an object of the present invention to provide a therapeutic device that may increase kinesthetic and proprioceptive awareness, increased range of motion, and provide sustained response and exponential benefits with regular use.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

Figure 6:
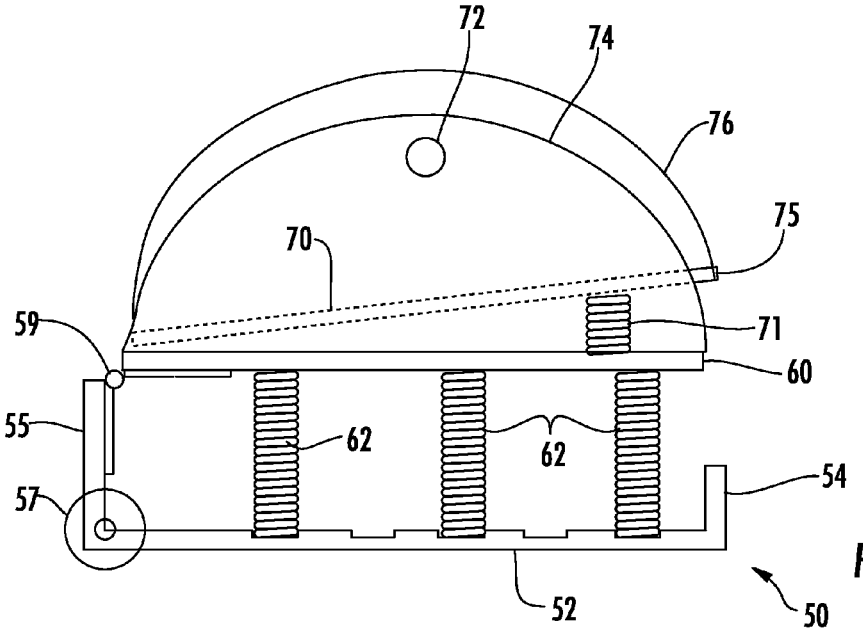
Figure 7:
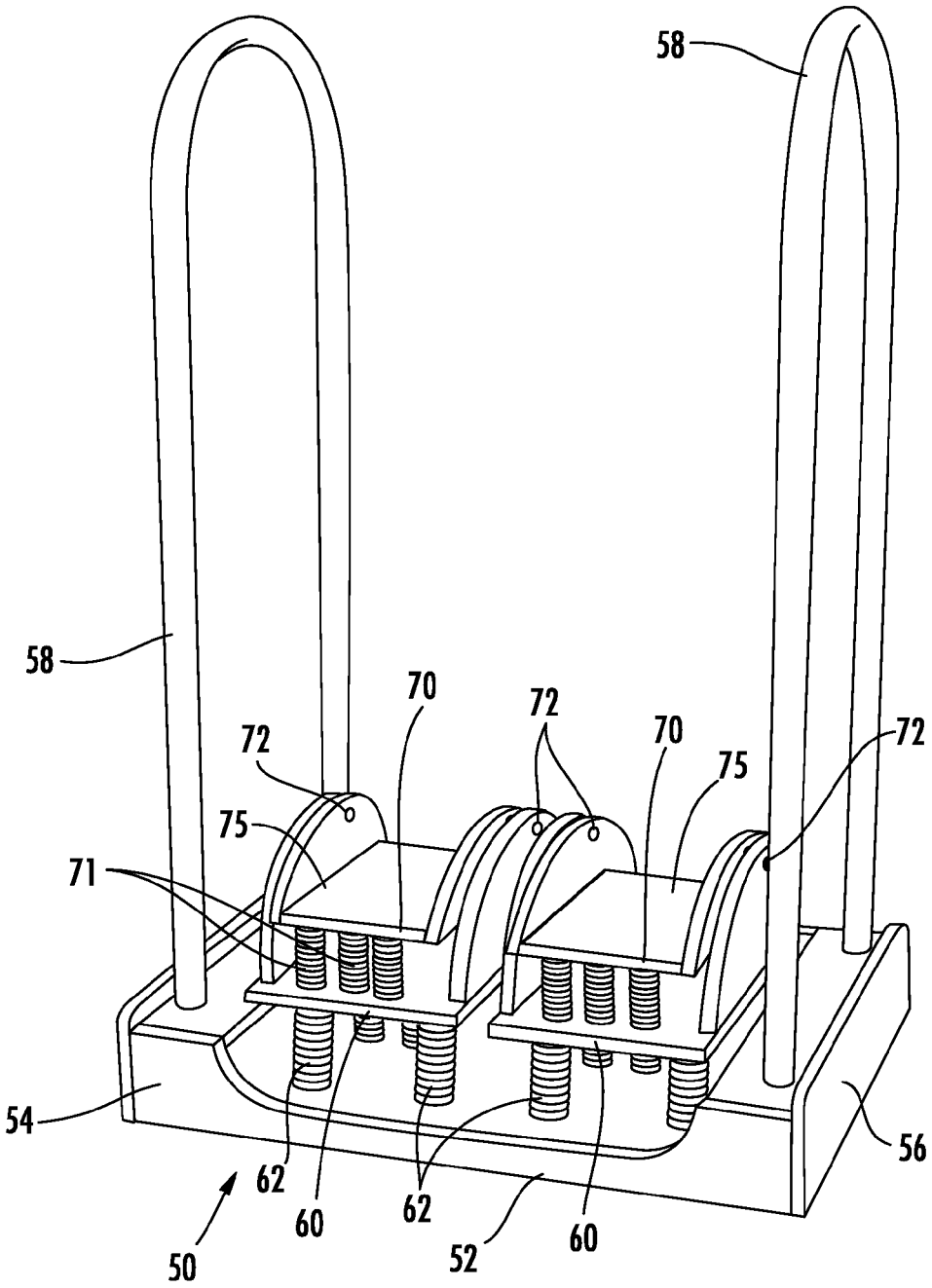
Figure 8:
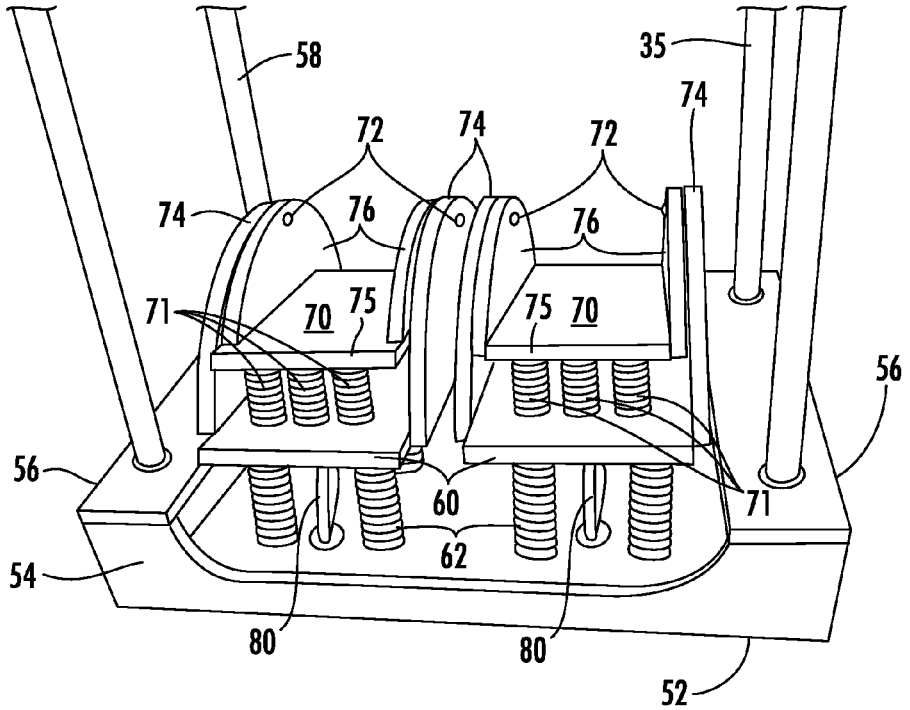
Figure 9:
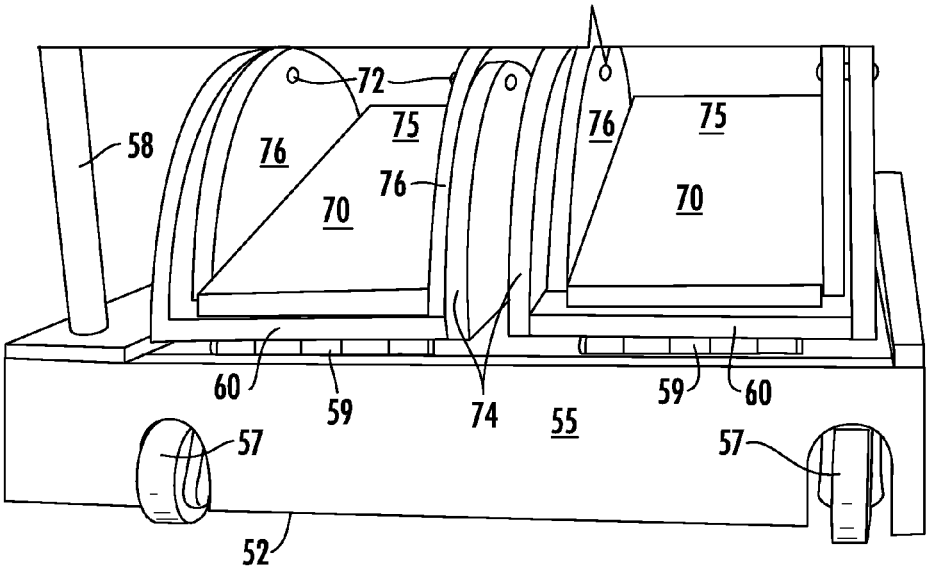
Figure 10:
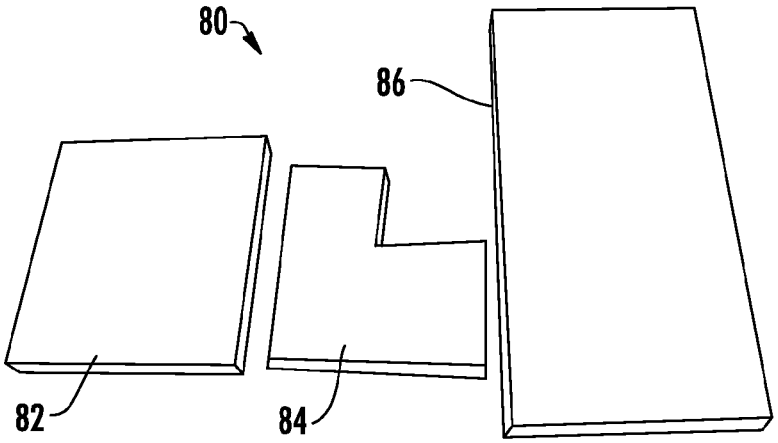

Figure five is a perspective view of the inside of a therapeutic device in accordance with the principles of the present invention;

FIG. 6 is a cross-sectional view of an alternative embodiment of a therapeutic device in accordance with principles of the present invention;

FIG. 7 is a perspective view of an alternative embodiment of a therapeutic device in accordance with the principles of the present invention;

FIG. 8 is an enlarged perspective front view of an alternative embodiment of a therapeutic device in accordance with the principles of the present invention;

FIG. 9 is a rear view of an alternative embodiment of a therapeutic device in accordance with the principles of the present invention;

FIG. 10 is an exploded view of a foot bed for use with a therapeutic device in accordance with the principles of the present invention.

Figure 11:
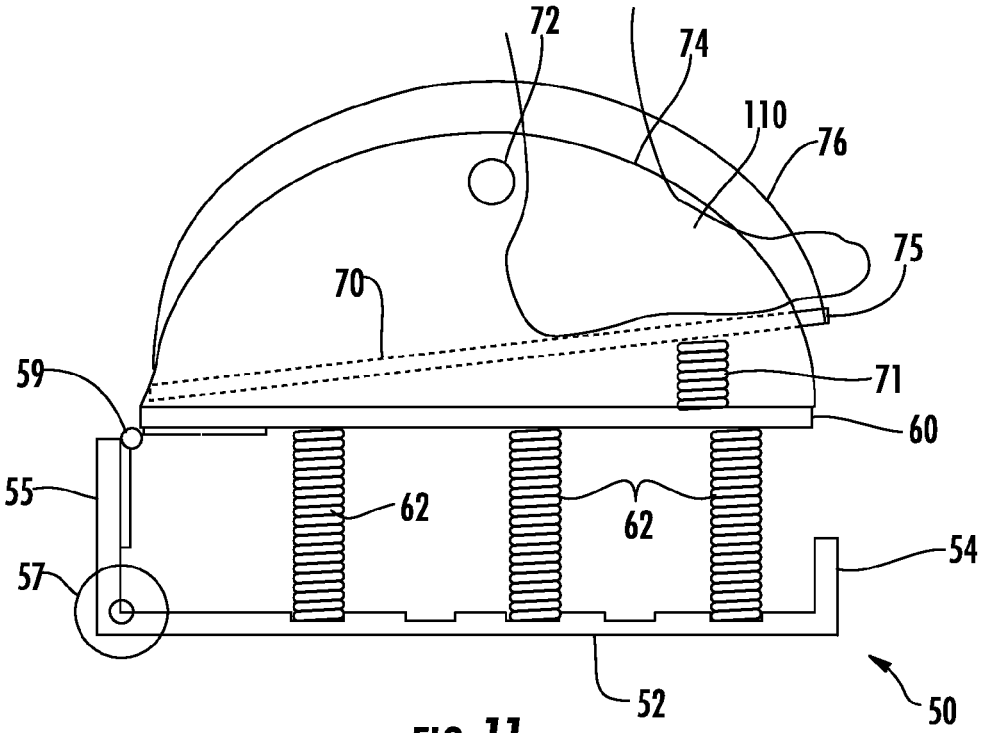

FIG. 11 is a side cross-sectional view of an alternative embodiment of a therapeutic device in accordance with the principles of the present invention.

DETAILED DESCRIPTION

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The Harwin Balancer™ has proven to be gentle and easy to use for all ages and across a broad spectrum of fitness levels. The subtle, complex, multi-tiered architecture of its footbed mechanism offers a yielding resistance coupled with subtle fulcrum, torsion, and sway actions that are easily controlled by the patient, yet profound in their effect. It has been clinically shown that The Harwin Balancer™ does not cause any exacerbation of the patient's condition.

Figure 1:
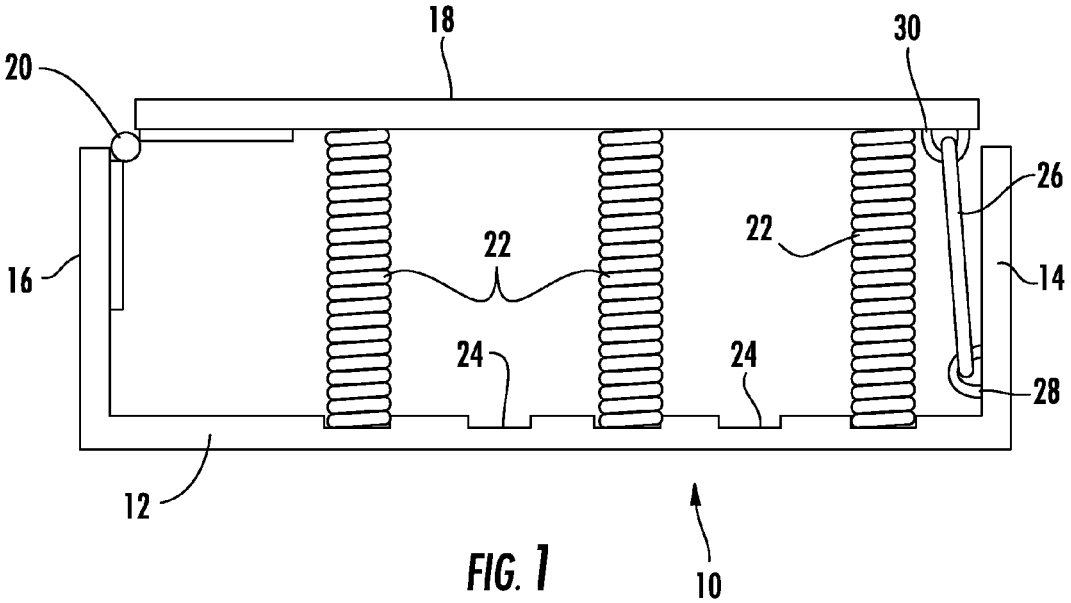
FIG. 1 is a cross-sectional view of a therapeutic device in accordance with the principles of the present invention.

FIG. 1 shows side cross-sectional view a therapeutic balancing device 10 in accordance with the principles of the present invention. The therapeutic device 10 has a base 12, a front 14 and a back 16. A platform 18 extends across the top of the therapeutic device from the back 16 to the front 14. Hinge 20 rotatably connects the back 16 to the platform 18. As will be explained more fully below, a patient stands upon platform 18. The therapeutic device may be constructed of any of a variety of suitable materials having sufficient strength and rigidity to support a person. In one embodiment, and may be preferable to use wood to construct the base 12, front 14, back 16 and platform 18. However, a variety of other materials may also be suitable, such as for example, plastic, metal, carbon fiber, and various composite materials.

Within the therapeutic device 10 one or more springs 22 may be situated. Base 12 may include one or more depressions 24 that may be circular, and may be used to accommodate the base of a spring 22. It may be desirable to have a variety of depressions 24 in order to allow one or more springs 22 to be placed in a variety of different positions. Rearranging springs 22 in different depressions 24 may aid in promoting alleviation of different conditions. Springs 22 may be steel, copper, or of any suitable material. It may be desirable to utilize a variety of different springs having a variety of different strengths and other properties to further assist in alleviating various conditions.

It may be desirable to include tether 26 that may be removably attachable to hooks 28 and 30. By tethering the platform 18 to the rest of the device, the springs may be prevented from moving out of place during transport. Optionally, the tether 26 may be elastic. Optionally, other methods of securing the therapeutic device may be used during transport or storage.

Figure 2:
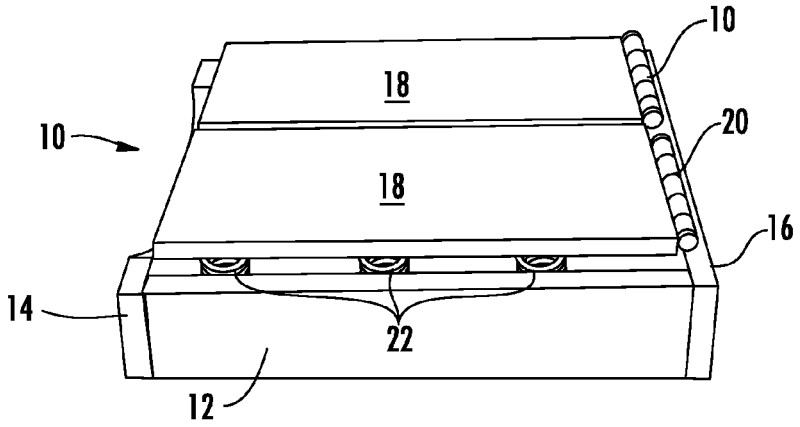
FIG. 2 is a side perspective view of a therapeutic device in accordance with the principles of the present invention.

FIG. 2 shows the therapeutic device 10 from a side perspective view. In this embodiment, the therapeutic device 10 has two platforms 18, one for each foot. Each platform 18 has a hinge 20 affixing it to the back 16. The therapeutic device 10 optionally include sides 32. Springs 22 may also be seen. This embodiment is relatively compact and has fewer moving components than other embodiments. This may make it a preferred embodiment for situations where highly portable devices are desirable.

Figure 3:
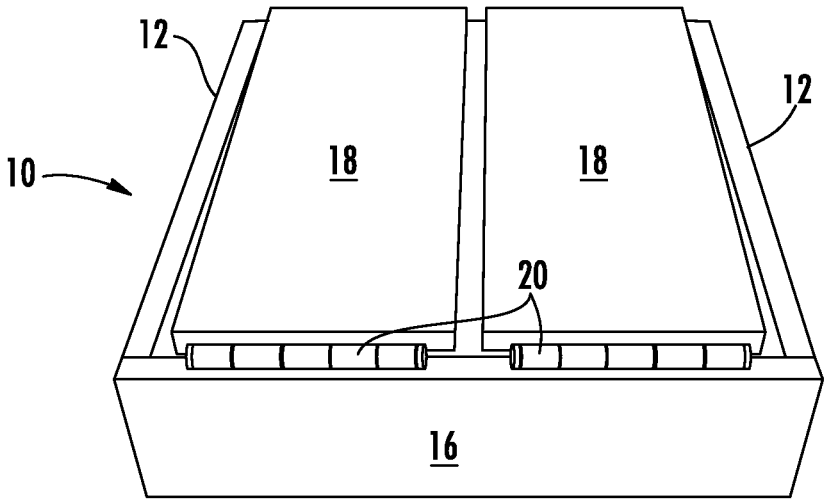
FIG. 3 is a back perspective view of a therapeutic device in accordance with the principles of the present invention.
Figure 4:
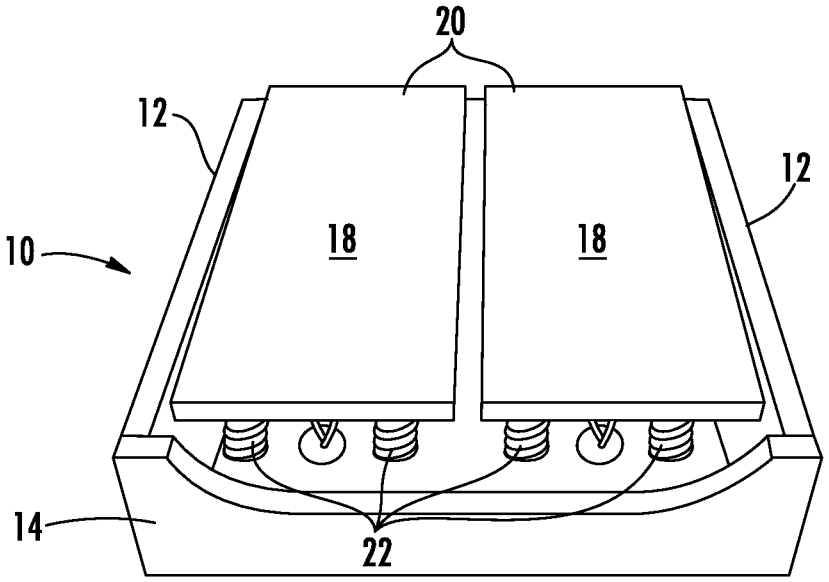
FIG. 4 is a front perspective view of a therapeutic device in accordance with the principles of the present invention.

FIG. 3 shows the portable embodiment of FIGS. 1 and 2 from the rear. The platforms 18 of therapeutic device 10 may be seen affixed to the back 16 by hinges 20. Both sides 32 may also be seen. In this embodiment, the therapeutic device has bilateral symmetry. It may be preferable for platforms 18 to be of the same size. FIG. 4 shows the therapeutic device 10 from the front. May be seen affixed by hinges 20. Springs 22 may also be seen.

Figure 5:
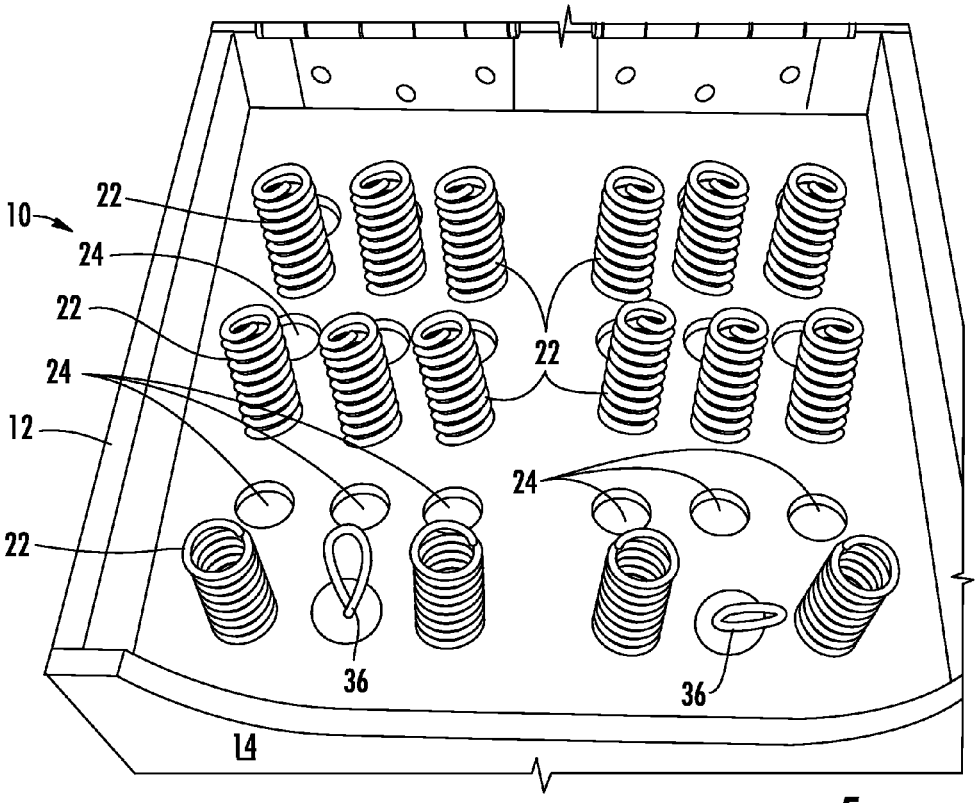

FIG. 5 shows the interior of the therapeutic device 10. As may be seen, a plurality of springs 22 are dispersed throughout the interior of the therapeutic device 10. Also may be seen are indentions 24. Springs 22 fit within indentions 24 that may assist holding springs 22 in place. Springs 22 may be arranged about indentions 24 in any pattern desired. Different placements of springs 22 in indentions 24 may be used to apply therapy differently depending on the patient and the various conditions treated. Also may be seen are bungee cords and balls 36. Bungee cords and balls 36 may be used to tethered down the platforms 18 to prevent them from bouncing upward and to help retain them in place.

FIG. 6 shows a side cross-sectional view of an alternative embodiment of a therapeutic device 50 in accordance with the principles of the invention. Therapeutic device 50 has a base 52, a front 54 and a back 55. Near the bottom of the back 55 close to where it meets base 52 is a wheel 57. Wheel 57 will be explained in greater detail below. A platform 60 extends across the top of therapeutic device 50 and is attached to back 55 by hinge 59. Springs 62 inside therapeutic device 50 extend from the base 52 to the platform 60. Springs 62 may be placed at one or more of many various locations about base 52 in order to adjust the therapeutic device 50 depending upon the operator.

Platform 60 has two half circle-shaped sidewalls 74 that extend upward from it. An upper platform 70 is positioned above platform 60. Upper platform 70 also has two sidewalls 76 that protrude upwardly from it. Sidewalls 74 and sidewalls 76 are rotatably attached to one another by pivot pin 72. Upper platform 70 is also attached to platform 60 by spring 71. The location of spring 71 creates a bias pushing the front end 75 of upper platform 70 upward. In operation, a person stands upon upper platform 70 facing the direction of the front 54. Thus, spring 71 is positioned close to where the ball of the foot rests upon platform 70. Spring 71 may also be placed in other locations and may consist of multiple springs under upper platform 70.

When a person stands upon the therapeutic device 50, the elastic forces of Springs 62 and 71 oscillate causing platform 60 to rotate about hinge 59 and platform 70 to rotate about an axis line running through pivot pin 72. This may require a user to adjust his or her balance. Without being bound by theory, the inventor believes that the balancing adjustments required when standing upon the therapeutic device takes advantage of neuroplasticity to enhance neuromuscular interaction and improve a person's balance.

Springs 71 and 62 may be composed of the same material or different materials. It may be desirable to provide a plurality of interchangeable springs having different mechanical properties to allow adjustment of the therapeutic device, depending on the needs of an operator. Optionally, it may be desirable to utilize mechanical structures other than classic mechanical springs to create biases in the platform and upper platform, such as, for example, hydraulic or pneumatic devices or armatures.

FIG. 7 shows a forward perspective view of the therapeutic device 50 of FIG. 6 in accordance with the principles of the invention. Therapeutic device 50 may be more complex and/or more elaborate than therapeutic device 10 of FIGS. 1-5. Therapeutic device 50 has sides 56, from which handlebars 58 extend upward. Handlebars 58 may be curved and in the shape of an upside down U, or other suitable design. In this embodiment, handlebars 58 are comprised of steel, however, other suitable materials may also be used, including wood, plastic, carbon fiber, glass and the like. Platforms 60 are supported by steel springs 62 that extends from the base 52 to the bottom of the platforms 60. Copper Springs 71 extend from platform 62 to the bottoms of platforms 70. Platforms 70 may optionally include foot beds 75. Foot beds 75 may be comprised of one or more layers of foam, rubber, plastic, cotton or any other material.

FIG. 8 is an enlarged perspective view from the front of the therapeutic device 50. In this embodiment, each upper platform 70 may be supported by three copper springs 71. It may be desirable to have more or fewer Springs 71. It may also be desirable to have Springs composed of materials other than copper. Springs 71 create a bias pushing the front 75 of the upper platform 70 upward.

Sidewalls 74 and sidewalls 76 are attached to one another by pivot pin 72. In this embodiment, sidewalls 74 and 76 are both semicircular in shape. However, sidewalls 74 and 76 may be of any shape or may simply be small planks extending upward from platform 60 an upper platform 70 in order to allow upper platform 70 to pivot relative to platform 60 about an axis line positioned above both platforms 60 and upper platforms 70. Also may be seen are bungee tethers with ball anchors 80 that assist in holding platforms 60 in place and prevent them from rotating too far upward about hinge 59.

FIG. 9 shows the back of the therapeutic device 50. Wheels 57 may be seen that may be used to assist in transporting the therapeutic device 50. Hinges 59 rotatably connect platforms 60 with back 55. Upper platforms 70 are not connected by a hinge or other means to platforms 60 or back 55. Platforms 70 only move by rotating about pivot pins 72. This rotating movement is biased by springs 71. Platforms 60 only moved by rotating about hinge 59, and this movement is biased by springs 62.

FIG. 10 shows an exploded view of a foot bed 80 for use with a therapeutic device in accordance with principles present invention. A foot bed 80 may be placed on top of upper platforms 70 in FIGS. 6-9 to enhance the therapeutic effects of the device and/or for comfort. A foot bed 80 may be comprised of three or more layers, a bottom layer 82 middle layer 84 and a top layer 86. The layers may be glued together. In this embodiments, layers 82, 84 and 86 are comprised of foam. Other materials may also be used as desired. A foot bed 80 may be permanently affixed to an upper platform 70 using, adhesives, glue or other appropriate materials. Alternatively foot bed 80 may be removably affixed to platform 70, thereby allowing other footbeds or no foot bed to be used in conjunction with the therapeutic device. Footbeds 80 may also be used with the embodiment of a therapeutic device 10 shown in FIGS. 1-5. The layers of the footbeds may be of a variety of shapes, and materials. For example, the layers may be rounded, elliptical, rectangular, and consist of a wide variety of shapes.

FIG. 11 shows the therapeutic device 50 interacting with a person's foot 110. The foot may be placed such that the toes extend beyond the edge of platform 70. The pivot pin 72 and it axis of rotation may be posterior to the ankle. In operation, a person places both feet on both platforms 70 and stands upon them. The elastic forces and biases provided by the Springs 62 and 71 upon platforms 60 and 70 may cause the person to adjust their balance. As a result, and for reasons not entirely understood, use of the therapeutic device 50 may take advantage of a person's narrow plasticity, especially relating to balance, in order to improve a person's gait and ability to walk. Use of the therapeutic device 50 may also result in alleviation of pain associated with walking and balance. FIG. 11 shows the foot, 110 placed near the forward end of platforms 70. It may optionally be desirable to place further back on platform 70.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A therapeutic device, comprising:
- a base;
- a lower platform located above the base;
- one or more springs that extend between the base and the lower platform and that bias a portion of the lower platform upward relative to the base;
- an upper platform located above the lower platform, and thus, also above the base;
- one or more further springs that extend between the lower platform and the upper platform and that bias a portion of the upper platform upward relative to the lower platform;
- a first pair of sidewalls that extend upward from the lower platform;
- a second pair of sidewalls that extend upward from the upper platform; and
- a pair of pivot pins that connect the first pair of sidewalls to the second pair of sidewalls;
- wherein the upper platform is pivotable relative to the lower platform about a rotational axis that extends between the pair of pivot pins and is located above the lower and upper platforms.

2. The therapeutic device of claim 1, wherein the upper platform is configured to engage and support a human foot.

3. The therapeutic device of claim 2, wherein the rotational axis, that extends between the pair of pivot pins, is positioned to be posterior to a human foot supported by the upper platform when toes of the human foot extend beyond a front edge of the upper platform.

4. The therapeutic device of claim 1, wherein:
- the base is configured to be parallel to and supported by a floor or ground on which the therapeutic device rests.

5. The therapeutic device of claim 1, wherein the one or more springs include at least two springs.

6. The therapeutic device of claim 1, further comprising:
- a wall extending upward from the base; and
- a hinge that rotatably attaches one end of the lower platform to the wall.

7. A therapeutic device, comprising:
- a base;
- a wall extending upward from the base;
- a left lower platform;
- a right lower platform;
- a left hinge that rotatably attaches one end of the left lower platform to the wall;
- a right hinge that rotatably attaches one end of the right lower platform to the wall;
- one or more left springs that bias a portion of left lower platform upward relative to the base; and
- one or more right springs that bias a portion of right lower platform upward relative to the base;
- left and right upper platforms located respectively above the left and right lower platforms;

one or more further left springs that extend between the left lower platform and the left upper platform and that bias a portion of the left upper platform upward relative to the left lower platform; and one or more further right springs that extend between the right lower platform and the right upper platform and that bias a portion of the right upper platform upward relative to the right lower platform;

a first left pair of sidewalls that extend upward from the left lower platform;

a second left pair of sidewalls that extend upward from the left upper platform;

a left pair of pivot pins that connect the first left pair of sidewalls to the second left pair of sidewalls;

a first right pair of sidewalls that extend upward from the right lower platform;

a second right pair of sidewalls that extend upward from the right upper platform;

a right pair of pivot pins that connect the first right pair of sidewalls to the second right pair of sidewalls;

wherein the left and right hinges cause the left and right lower platforms to be rotatable independent of one another;

wherein the left upper platform is pivotable relative to the left lower platform about a rotational axis that extends between the left pair of pivot pins and is located above the left lower and upper platforms; and wherein the right upper platform is pivotable relative to the right lower platform about a rotational axis that extends between the right pair of pivot pins is located above the right lower and upper platforms.

8. The therapeutic device of claim 7, wherein:

the left upper platform is configured to engage and support a left human foot; and the right upper platform is configured to engage and support a right human foot.

9. The therapeutic device of claim 7, wherein the right upper platform is pivotable relative to the right lower platform independent of the left upper platform being pivotable relative to the left lower platform.

10. The therapeutic device of claim 7, wherein:

the base is configured to be parallel to and supported by a floor or ground on which the therapeutic device rests.

11. The therapeutic device of claim 7, wherein:

the one or more left springs include at least two left springs;

the one or more right springs include at least two right springs;

the one or more further left springs include at least two further left springs; and the one or more further right springs include at least two further right springs.

12. The therapeutic device of claim 7, wherein:

the base is configured to be parallel to and supported by a floor or ground on which the therapeutic device rests; and the base includes a left base portion that is below the left lower platform and a right base portion that is below the right lower platform.

13. A therapeutic device, comprising:

a left base portion;

a left wall portion extending upward from the left base portion;

a left lower platform including a portion biased upward by one or more left springs that extend between the left base portion and the left lower platform;

a left hinge portion that rotatably attaches one end of the left lower platform to the left wall portion;

a left upper platform including a portion biased upward by one or more further left springs that extend between the left lower platform and the left upper platform;

a left pair of pivot pins located above the left lower and upper platforms;

a right base portion;

a right wall portion extending upward from the right base portion;

a right lower platform including a portion biased upward relative to the right base portion by one or more right springs that extend between the right base portion and the right lower platform; and a right hinge portion that rotatably attaches one end of the right lower platform to the right wall portion;

a right upper platform including a portion biased upward by one or more further right springs that extend between the right lower platform and the right upper platform;

a right pair of pivot pins located above the right lower and upper platforms;

wherein the left and right hinge portions cause the left and right platforms to be rotatable independent of one another;

wherein the left upper platform is pivotable relative to the left lower platform about a rotational axis that extends between the left pair of pivot pins; and wherein the right upper platform is pivotable relative to the right lower platform about a rotational axis that extends between the right pair of pivot pins.

14. The therapeutic device of claim 13, wherein the left upper platform is configured to engage and support a first human foot; and the right upper platform is configured to engage and support a second human foot.

15. The therapeutic device of claim 13, further comprising:

a first pair of left sidewalls that extend upward from the left lower platform;

a second pair of left sidewalls that extend upward from the left upper platform;

a first pair of right sidewalls that extend upward from the right lower platform;

a second pair of right sidewalls that extend upward from the right upper platform;

wherein the left pair of pivot pins pivotably connect the first left pair of sidewalls to the second left pair of sidewalls; and wherein the right pair of pivot pins pivotably connect the first right pair of sidewalls to the second right pair of sidewalls.

* * * * *